US008717127B2

(12) United States Patent
Ando et al.

(10) Patent No.: US 8,717,127 B2
(45) Date of Patent: May 6, 2014

(54) CIRCUIT BREAKER

(75) Inventors: Shinichiro Ando, Kounosu (JP); Koji Asakawa, Kounosu (JP); Akifumi Sato, Kounosu (JP); W. P. Hemantha Desilva, Kounosu (JP); Tomoo Yamazaki, Saitama (JP)

(73) Assignee: Fuji Electric FA Components & Systems Co., Ltd., Tokyo (JP)

( * ) Notice: Subject to any disclaimer, the term of this patent is extended or adjusted under 35 U.S.C. 154(b) by 0 days.

(21) Appl. No.: 13/702,879

(22) PCT Filed: Sep. 12, 2011

(86) PCT No.: PCT/JP2011/005107

§ 371 (c)(1),
(2), (4) Date: Feb. 12, 2013

(87) PCT Pub. No.: WO2012/035741

PCT Pub. Date: Mar. 22, 2012

(65) Prior Publication Data

US 2013/0162377 A1 Jun. 27, 2013

(30) Foreign Application Priority Data

Sep. 15, 2010 (JP) ..... 2010-206970

(51) Int. Cl.
*H01H 75/00* (2006.01)

(52) U.S. Cl.
USPC ..... 335/16; 335/8

(58) Field of Classification Search
USPC ..... 335/16
See application file for complete search history.

(56) References Cited

U.S. PATENT DOCUMENTS

| | | | | |
|---|---|---|---|---|
| 4,611,187 | A * | 9/1986 | Banfi | 335/16 |
| 4,680,562 | A * | 7/1987 | Bratkowski et al. | 335/16 |
| 5,231,365 | A * | 7/1993 | Kato | 335/132 |
| 5,917,390 | A * | 6/1999 | Papallo et al. | 335/16 |
| 6,975,190 | B2 * | 12/2005 | Sato et al. | 335/16 |
| 7,154,062 | B2 * | 12/2006 | Asakawa et al. | 218/155 |
| 7,187,258 | B2 * | 3/2007 | Yamazaki et al. | 335/201 |
| 7,482,901 | B2 * | 1/2009 | Watanabe et al. | 335/201 |

(Continued)

FOREIGN PATENT DOCUMENTS

| | | |
|---|---|---|
| JP | H05-074316 A | 3/1993 |
| JP | 2864727 B2 | 3/1999 |

(Continued)

OTHER PUBLICATIONS

PCT, "International Search Report for PCT/JP2011/005107", Nov. 8, 2011.

*Primary Examiner* — Shawki S Ismail
*Assistant Examiner* — Lisa Homza
(74) *Attorney, Agent, or Firm* — Manabu Kanesaka

(57) ABSTRACT

A molded case houses switching parts and includes a case main body and a cover placed on an upper portion of the case main body. The case main body includes a bottom portion case that forms a bottom portion of a circuit breaker and an intermediate case, placed on an upper portion of the bottom portion case, having a dividing wall that blocks off a space between the intermediate case and the bottom portion case. A power source side terminal block and second movable contact are fitted inside the bottom portion case, and a first movable contact, the load side terminal block, the contact portion, and the arc extinguishing chamber are fitted inside the intermediate case.

5 Claims, 6 Drawing Sheets

(56) References Cited

U.S. PATENT DOCUMENTS

| | | | | |
|---|---|---|---|---|
| 7,535,327 | B2 * | 5/2009 | Desilva et al. | 335/174 |
| 7,777,601 | B2 * | 8/2010 | Kakisako et al. | 335/196 |
| 2005/0275493 | A1 * | 12/2005 | Yamazaki et al. | 335/202 |
| 2007/0035367 | A1 * | 2/2007 | Desilva et al. | 335/202 |

FOREIGN PATENT DOCUMENTS

| | | | |
|---|---|---|---|
| JP | 3296460 | B2 | 7/2002 |
| JP | 2007-048681 | A | 2/2007 |
| JP | 2009-037002 | A | 2/2009 |
| JP | 2009-140838 | A | 6/2009 |

* cited by examiner

CIRCUIT BREAKER

RELATED APPLICATIONS

The present application is National Phase of International Application No. PCT/JP2011/005107 filed Sep. 12, 2011, and claims priority from Japanese Application No. 2010-206970, filed Sep. 15, 2010.

TECHNICAL FIELD

The present invention relates to a circuit breaker such as a wiring breaker or earth leakage breaker, and in particular, relates to a repulsion type circuit breaker wherein contact points open due to a pivoting of a movable contact caused by electromagnetic repulsive force.

BACKGROUND ART

As a repulsion type circuit breaker, there is a two-point switch circuit breaker (for example, Patent Document 1) wherein two movable contact points open simultaneously.

FIG. 6 shows a circuit breaker of Patent Document 1. Reference numeral 1 is a case made of molded resin, and reference numeral 2 a cover made of molded resin, wherein a power source side terminal block 3, a second movable contact 4, a first movable contact 5, an arc extinguishing chamber 6, a switching mechanism 7, an overcurrent tripping device 8, a load side terminal block 9, and the like, are housed in the case 1.

The second movable contact 4 is pivotally supported by a support fitting 11 via a shaft 10 in the vicinity of a V-shaped portion of the second movable contact 4, and is urged toward the first movable contact 5 by a return spring 12 placed on the shaft 10.

Then, a lower end portion of the second movable contact 4 is connected to the power source side terminal block 3 via a lead 13. The support fitting 11 is fixed to the case 1 with a screw 14. Also, the power source side terminal block 3 is fixed to the case 1 with a screw 15.

The overcurrent tripping device 8 disposed between the first movable contact 5 and load side terminal block 9 includes a bimetal 16 and an electromagnet (not shown), and the electromagnet has a configuration wherein a coil 19 is coiled around an iron core 18 joined to a yoke 17, and a return spring 21 is provided between an armature 20, opposing the iron core 18 and pivotally supported by the yoke 17, and the yoke 17.

The bimetal 16 is joined to an L-shaped fitting 22, and the L-shaped fitting 22 is fixed with a screw 25 to a flat conductor 24 connected to the first movable contact 5 via a lead 23. The flat conductor 24 is fixed to the case 1 with a screw 26, and the yoke 17 is fixed to the case 1 with a screw 27. An upper end portion of the bimetal 16 and one end of the coil 19 are connected via a lead 28, and the other end of the coil 19 is connected to the load side terminal block 9.

Also, the circuit breaker of FIG. 6 is of a structure wherein the power source side terminal block 3 and support fitting 11 supporting the second movable contact 4 are unitized by being integrally assembled on a common insulating base 33, and the unit is fitted into the case 1 inside which the first movable contact 5 and switching mechanism 7 are fitted, from a bottom surface side thereof, and covered with a base cover 41.

The circuit breaker in the closed condition shown in FIG. 6 is such that current flows from the power source side terminal block 3 through the lead 13, second movable contact 4, first movable contact 5, lead 23, flat conductor 24, L-shaped fitting 22, bimetal 16, lead 28, and coil 19, to the load side terminal block 9. When an energizing current in the circuit breaker reaches an overload condition, the bimetal 16 distorts, releasing a lock of the switching mechanism 7, and the first movable contact 5 is opened. Also, when a large current such as a short circuit current flows through the circuit breaker, the armature 20 attracted to the iron core 18 releases the lock of the switching mechanism 7, but as the currents flowing through the second movable contact 4 and first movable contact 5 flow in mutually opposite directions, as shown by arrows in the drawing, the second movable contact 4 and first movable contact 5 are such that the second movable contact 4 is driven in a counterclockwise direction in the drawing, and the first movable contact 5 in a clockwise direction in the drawing, before the release of the switching mechanism lock, due to an electromagnetic repulsion acting between the second movable contact 4 and first movable contact 5. Because of this, an arc is generated between the two contacts 4 and 5, increasing the arc voltage, after which, the switching mechanism operates under a command from the overcurrent tripping device 8, and a current limiting and breaking is carried out in a short time.

RELATED ART DOCUMENTS

Patent Documents

Patent Document 1: Japanese Patent No. 3,296,460

DISCLOSURE OF THE INVENTION

Problems to be Solved by the Invention

However, even though the external form of the circuit breaker is the same, one portion of the parts is altered depending on the breaking capacity and rated current. In this case, the circuit breaker of FIG. 6 is such that, in order to meet market delivery date, a certain quantity of some kinds of the circuit breakers, wherein only one portion of the parts differs, is assembled in advance and stocked. However, this kind of heretofore known method increases wasteful stock, and as well as cost reduction being hindered, there is a problem from the aspects of assemble ability and maintenance ability.

Also, the circuit breaker of FIG. 6 is such that, when the first movable contact 5 and second movable contact 4 open due to electromagnetic repulsion, the current that has once increased now decreases, upon which, because of a decrease in the electromagnetic repulsion, the second movable contact 4 moves in a closing direction due to the return force of the return spring 12. Because of this, there is a problem in that the arc length contracts as a result of a decrease in the opening distance of the first movable contact 5 and second movable contact 4, and current-limiting performance decreases due to a decrease in arc voltage. Furthermore, as a break of the energizing path becomes impossible immediately after the flow of a short circuit current unless a contact point gap length of a specified value or more is secured between the contact points of the first movable contact 5 and second movable contact 4, a sufficient contact point gap length is necessary immediately after the flow of a short circuit current.

Therefore, the invention, having been conceived focusing on the unsolved problems of the heretofore described heretofore known example, has an object of providing a repulsion type circuit breaker that can achieve a cost reduction by having good assembly ability and maintenance ability, and that can increase current-limiting performance and breaking performance.

Means for Solving the Problems

In order to achieve the heretofore described object, a circuit breaker according to one embodiment is such that a molded case housing a first movable contact having a first movable contact point disposed at a leading end thereof, a contact portion pivotally supporting the first movable contact through an insulating holder, a second movable contact having a second movable contact point disposed at a leading end thereof to contact with the first movable contact point, and connected to a power source side terminal block through a lead, a switching mechanism to switch the first movable contact, a load side terminal block connected to the first movable contact, an overcurrent tripping device connected to the load side terminal block, and an arc extinguishing chamber that extinguishes an arc generated between the first movable contact point and second movable contact point. The molded case is formed by a case main body and a cover placed on an upper portion of the case main body. The case main body comprises a bottom portion case that forms a bottom portion of the circuit breaker, and an intermediate case, placed on an upper portion of the bottom portion case, having a dividing wall that blocks off a space between the intermediate case and the bottom portion case. The power source side terminal block and the second movable contact are fitted inside the bottom portion case, and the first movable contact, the load side terminal block, the overcurrent tripping device, the holder, the contact portion, and the arc extinguishing chamber are fitted inside the intermediate case.

According to the circuit breaker according to the one embodiment, when a large current such as a short circuit current flows, and the second movable contact pivots in the opening direction due to an electromagnetic repulsion generated between the first movable contact point of the first movable contact and the second movable contact point of the second movable contact, the second movable contact engaging with the latch continues to be held in the predetermined open position by the latch of the latch mechanism pivoting due to the flow of an arc gas, and as the arc length between the first movable contact point and the second movable contact point does not contract, and the arc voltage does not drop, it is possible to improve current limiting performance.

Also, the circuit breaker according to one embodiment is such that the latch mechanism includes a side plate that pivotally supports a contact spring that urges the second movable contact toward the first movable contact, and the latch, via a shaft, and a gas pressure base that covers the side plate. The latch mechanism and the power source side terminal block connected to the second movable contact via the lead block are unitized. The unit, a magnetic yoke that encloses the second movable contact point of the second movable contact from left and right, and side portions thereof extend upright in an opening movement direction of the second movable contact, and a magnetic yoke cover covering the left and right side portions of the magnetic yoke on the inner and outer sides, are fitted inside the bottom portion case.

According to the circuit breaker according to the one embodiment, as the latch mechanism, second movable contact, and power source side terminal block inside the bottom portion case are unitized, it is possible to reduce the stock amount of the parts of the bottom portion case, thus achieving good assembly workability.

Also, the circuit breaker according to one embodiment is such that a molded wall is formed in the intermediate case in a form such as to connect an exterior side wall of the intermediate case and an interphase wall, and a power source side exhaust opening is formed by the molded wall and the cover.

According to the circuit breaker according to the one embodiment, as the power source side exhaust opening is formed by the cover and intermediate case formed by molding, the number of parts is reduced, a reduction in manufacturing cost is achieved, and the strength of the intermediate case increases.

Also, the circuit breaker according to one embodiment is such that the cover is configured of a first cover placed on an upper portion of the intermediate case, a second cover placed on an upper portion of the first cover, and a top cover placed on an upper portion of the second cover. The switching mechanism is fitted from the upper portion of the first cover in a state in which the second cover and top cover are removed.

According to the circuit breaker according to the one embodiment, it is possible to achieve good assembly ability and maintainability of the switching mechanism.

Also, the circuit breaker according to one embodiment is such that the overcurrent tripping device is connected to the load side terminal block fitted inside the intermediate case, and in a state in which the second cover and top cover are removed, fixing screws are inserted into cylindrical screw insertion holes formed from the bottom of the bottom portion case toward the intermediate case, and the fixing screws are screwed to the overcurrent tripping device.

According to the circuit breaker according to the one embodiment, as it is possible to respond to breaking capacity and rated current specifications by changing only the overcurrent tripping device, it is possible to respond flexibly to differences in breaking capacity and rated current with a small amount of stock.

Also, the circuit breaker according to one embodiment is such that a gas path is formed in a position on the load side terminal block side of the latch mechanism of the bottom portion case.

Furthermore, the circuit breaker according to one embodiment is such that the gas path communicates with the external air from a side portion of the bottom portion case.

According to the circuit breaker according to the one embodiment, as it is possible to form the gas path of the bottom portion case by molding, a reduction in manufacturing cost is achieved.

Advantage of the Invention

According to the circuit breaker according to the invention, as a molded case housing each part is configured of a case main body and a cover placed on an upper portion of the case main body, the case main body is configured of a bottom portion case that forms a bottom portion of the circuit breaker and an intermediate case, placed on an upper portion of the bottom portion case, having a dividing wall that blocks off a space between the intermediate case and the bottom portion case, placed on an upper portion of the bottom portion case, a power source side terminal block and second movable contact are fitted inside the bottom portion case, and a first movable contact, load side terminal block, overcurrent tripping device, holder, contact portion, and arc extinguishing chamber are fitted inside the intermediate case, it is possible to achieve good assembly ability and maintenance ability, and a cost reduction.

BEST MODE FOR CARRYING OUT THE INVENTION

Figure 6:
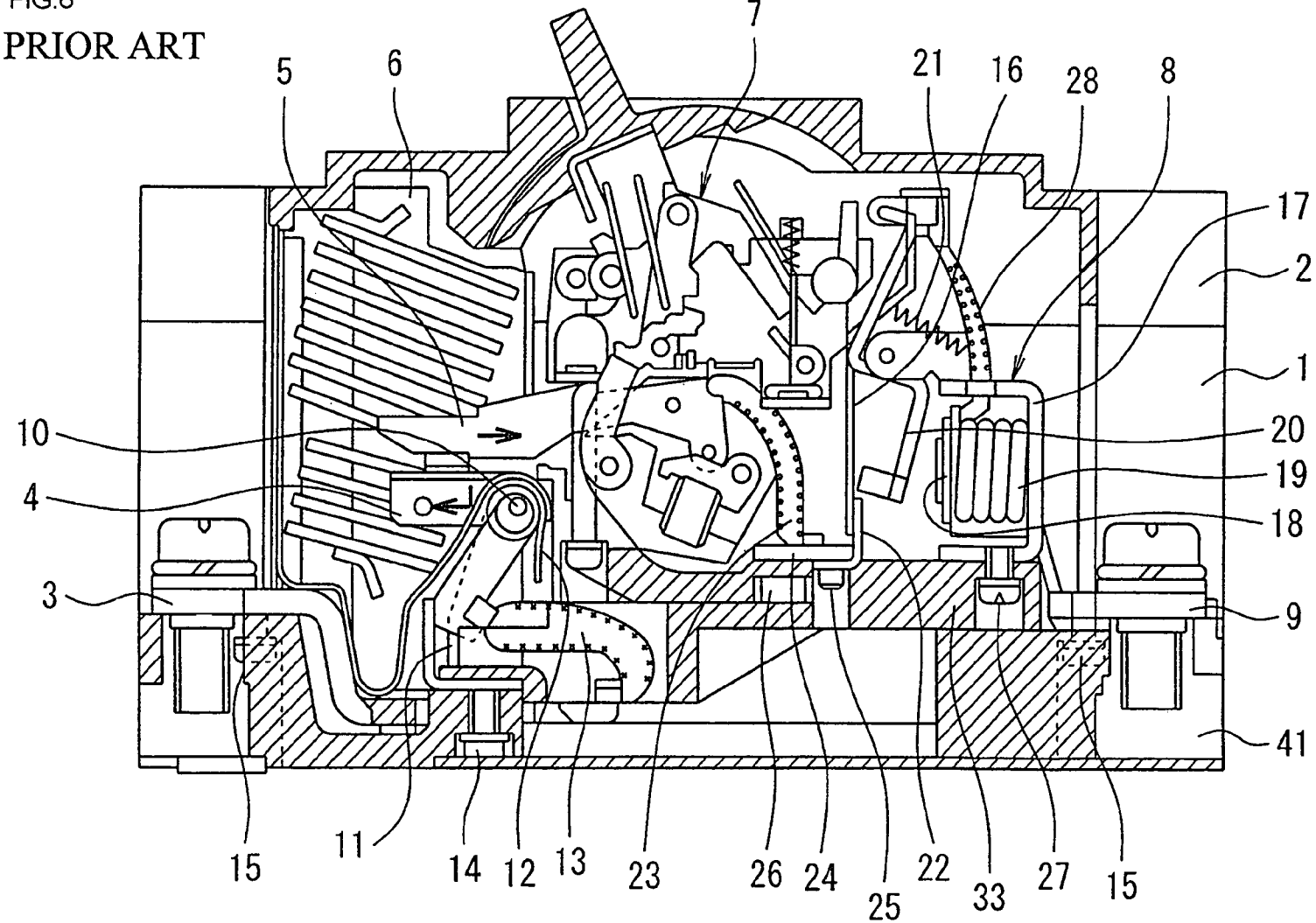
FIG.6 PRIOR ART
FIG. 6 is a sectional view showing a heretofore known circuit breaker.

Hereafter, a detailed description will be given, while referring to the drawings, of a best mode (hereafter referred to as an embodiment) for embodying a circuit breaker according to the invention. The same reference numerals and signs are given to portions of the configuration the same as those of the configuration shown in FIG. 6, and a description thereof is omitted.

Figure 1:
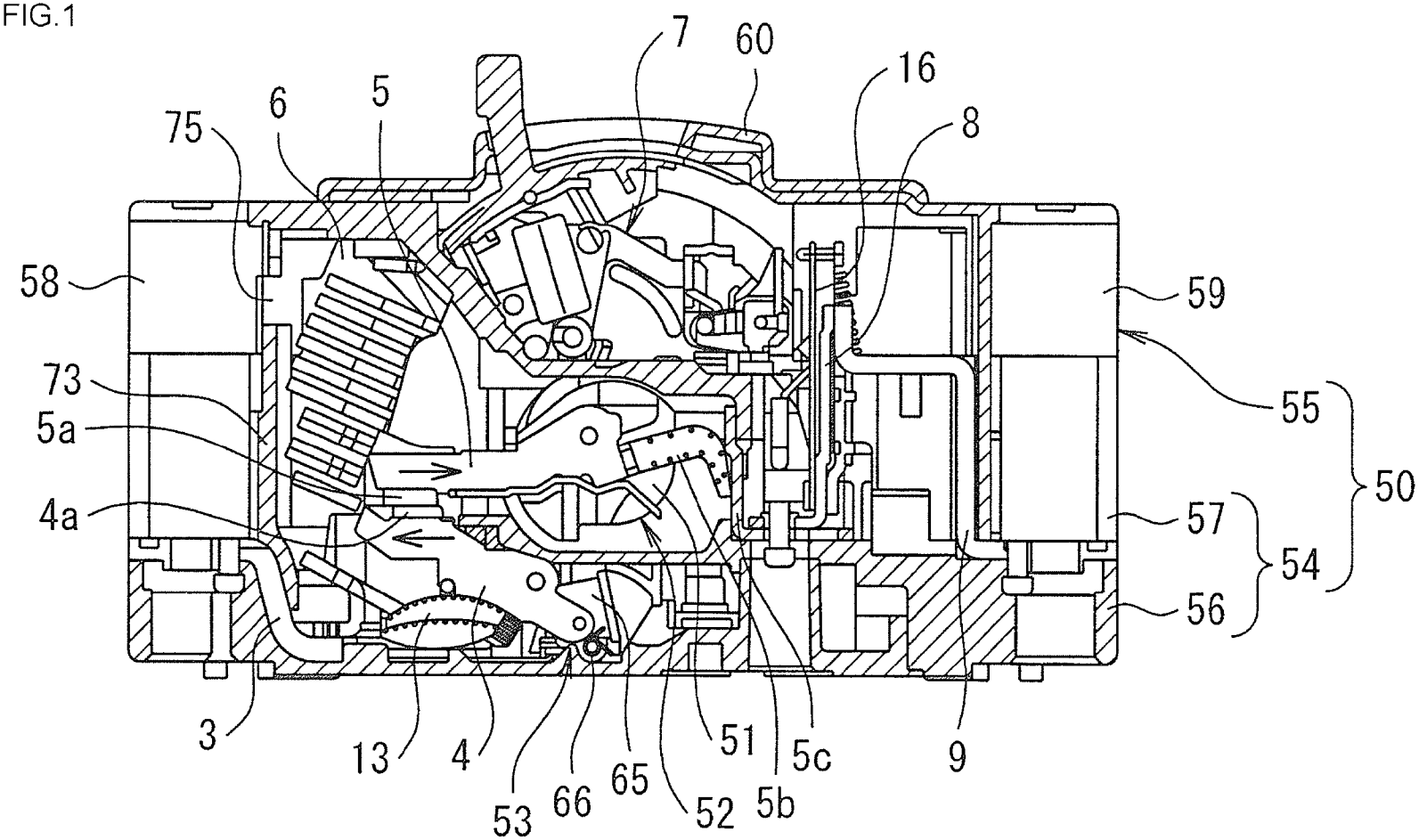
FIG. 1 is a sectional view showing a closed state of a circuit breaker according to the present invention.

The circuit breaker of the embodiment is such that a first movable contact 5 having a leading end provided a first movable contact point 5*a*, a contact portion 52 that pivotally supports the first movable contact 5 across an insulating holder 51, a second movable contact 4 having a leading end provided with a second movable contact point 4*a* that contacts with the first movable contact point 5*a* and connected to a power source side terminal block 3 via a lead 13, a switching mechanism 7 that switches the first movable contact 5, a load side terminal block 9 connected to the first movable contact 5 via a lead 5*b* and connecting board 5*c*, an overcurrent tripping device 8 connected to the load side terminal block 9, an arc extinguishing chamber 6 that extinguishes an arc generated between the first movable contact point 5*a* and second movable contact point 4*a*, and a latch mechanism 53 that operates together with the second movable contact 4, are housed inside a case 50 formed by resin molding, as shown in FIG. 1.

The case 50 is configured of a case main body 54 and a cover 55 placed on an upper portion of the case main body 54.

Figure 2:
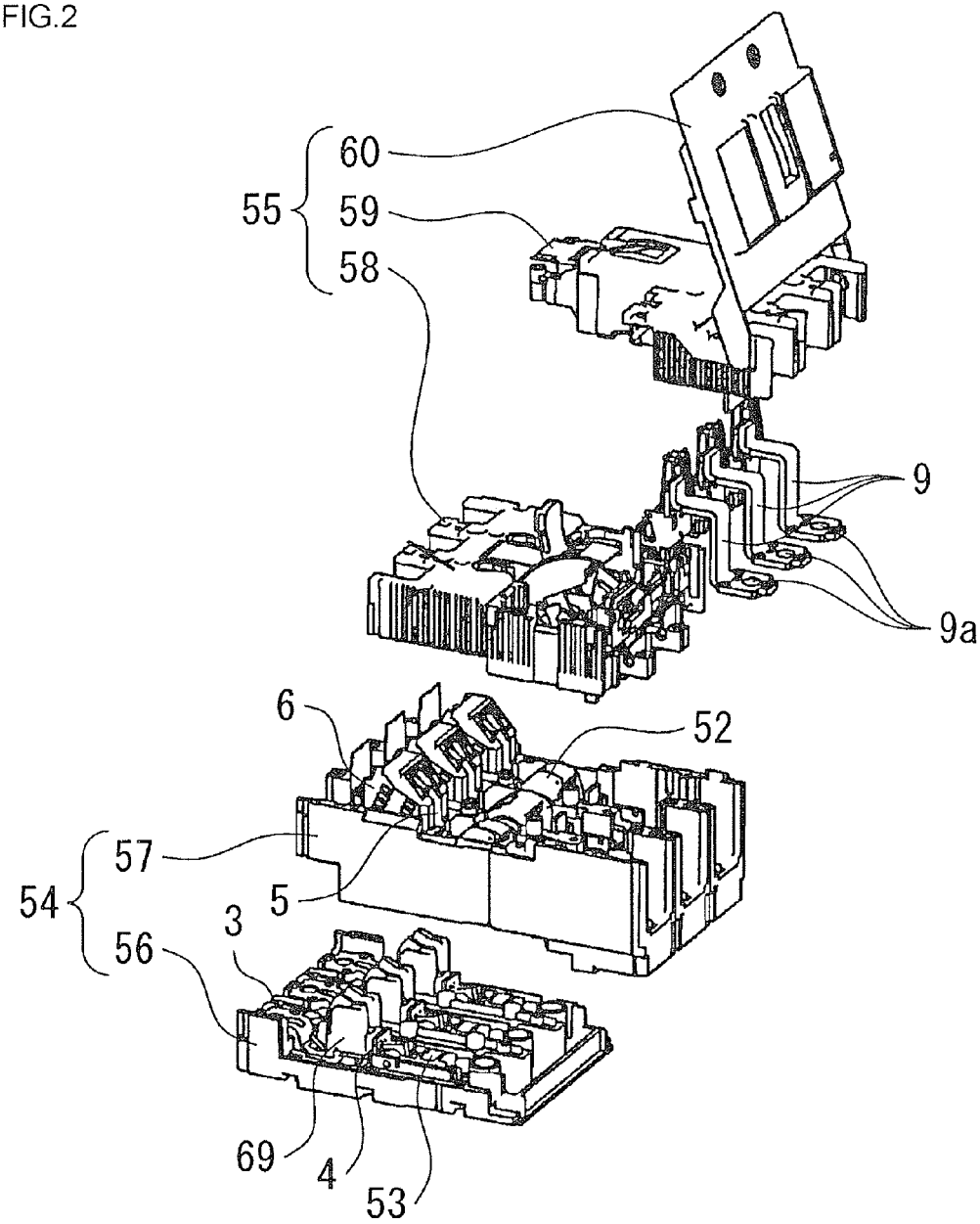
FIG. 2 is an exploded view showing components of the circuit breaker according to the present invention.

The case main body 54 is configured of a bottom portion case 56 that forms a bottom portion of the circuit breaker, and an intermediate case 57 placed on an upper portion of the bottom portion case 56, as shown in FIG. 2.

The cover 55 is configured of a first cover 58 placed on an upper portion of the intermediate case 57, a second cover 59 placed on an upper portion of the first cover 58, and a top cover 60 placed on an upper portion of the second cover 59, as shown in FIG. 2.

Figure 3:
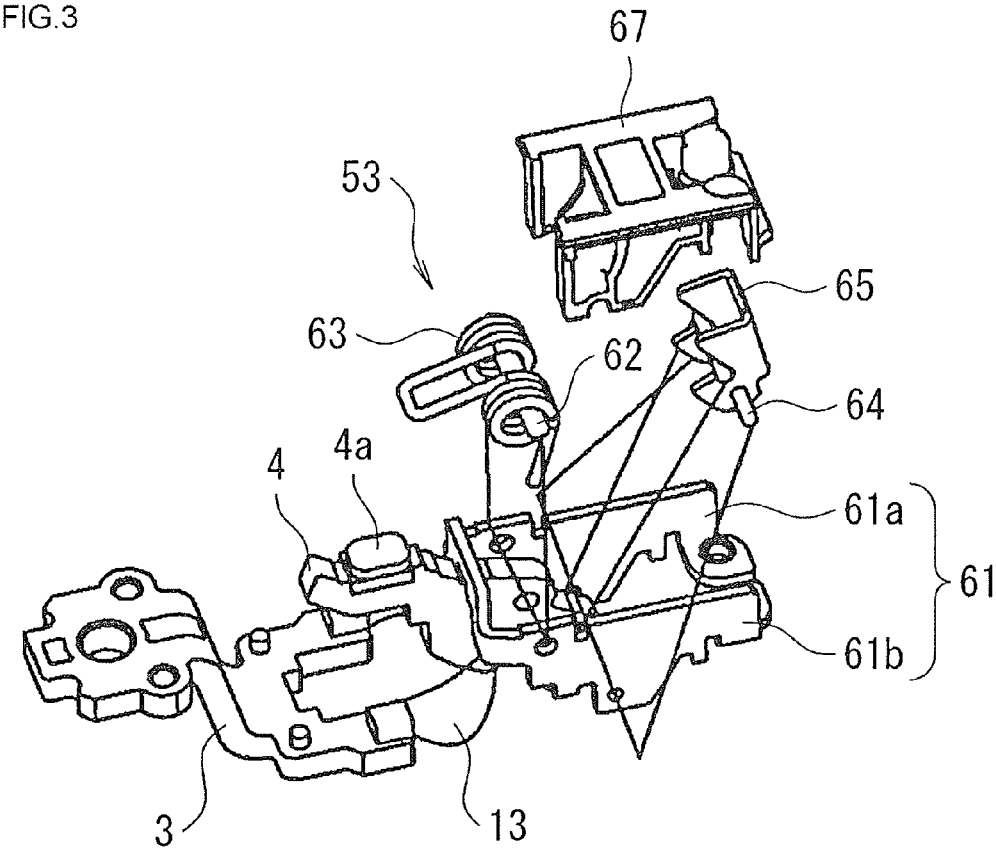
FIG. 3 is a diagram showing a latch mechanism configuring the circuit breaker according to the present invention.

The latch mechanism 53, as shown in FIG. 3, is a mechanism including a side plate 61 having parallel plates 61*a* and 61*b* opposed to each other in parallel, a contact spring 63, supported by a shaft 62 engaged with the side plate 61, that engages with the second movable contact 4, and urges the second movable contact point 4*a* side of the second movable contact 4 in an upward direction (a direction approaching the first movable contact point 5*a* of the first movable contact 5: a closing direction) in FIG. 2, a latch 65 that engages and operates together with the second movable contact 4 while being supported by a shaft 64 engaged with the side plate 61, a return spring (reference numeral 66 in FIG. 1) that engages with the latch 65 and second movable contact 4 while being supported by the shaft 64, and a gas pressure base 67 that covers an upper portion opening of the side plate 61, wherein the latch mechanism 53 is unitized by the power source side terminal block 3 being connected to the second movable contact 4 via the lead 13.

The latch 65, when pivoting in a clockwise direction around the shaft 64, engages with the second movable contact 4, which has moved in an opening direction (a direction away from the first movable contact point 5*a* of the first movable contact 5), and holds the second movable contact 4 in a predetermined open position. Also, the return spring 66 urges the latch 65 in a counterclockwise direction around the shaft 64.

Figure 4:
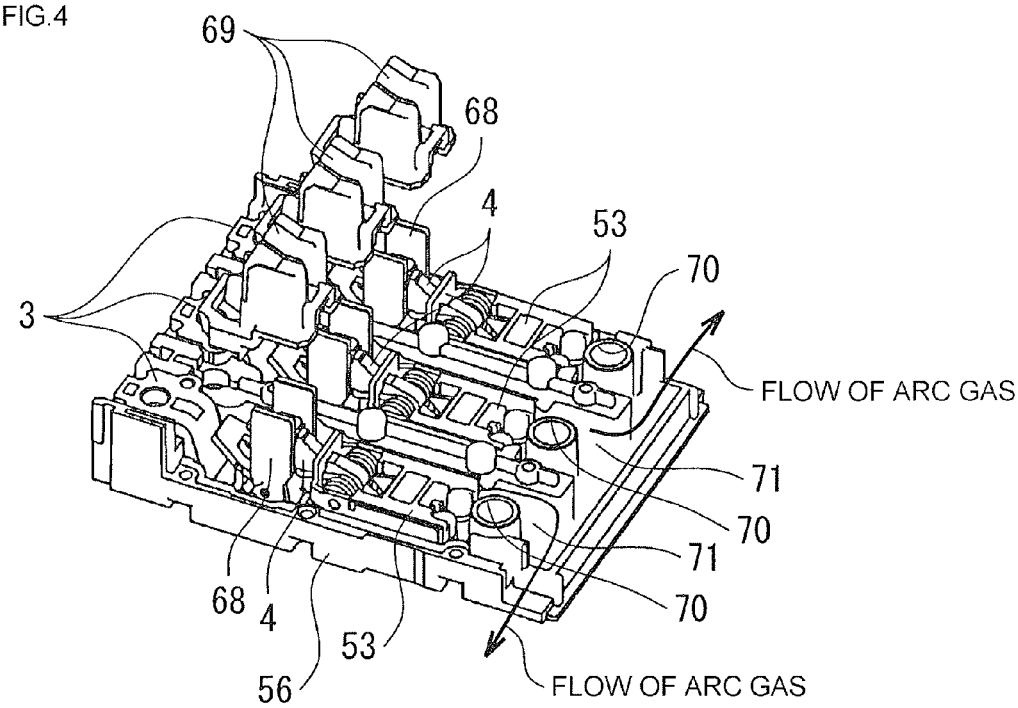
FIG. 4 is a diagram showing a bottom portion case configuring the circuit breaker according to the present invention, and parts housed inside the case.

Then, as shown in FIG. 4, the unit formed by the latch mechanism 53, the second movable contact 4, and the power source side terminal block 3, a magnetic yoke 68 that encloses the second movable contact point 4*a* of the second movable contact 4 from left and right, and side portions thereof extend upright in an opening movement direction of the second movable contact 4, and a magnetic yoke cover 69 that covers the left and right side portions of the magnetic yoke 68 on the inner and outer sides, are fitted inside the bottom portion case 56. Also, plural cylindrical screw insertion portions 70 are formed extending from the bottom portion toward the upper portion (the intermediate case 57) on the side of the bottom portion case 56 in which the latch mechanism 53 is fitted, and a gas path 71 communicating with the external air is formed in a side portion of the bottom portion case 56 among the screw insertion portions 70.

Also, the first movable contact 5, the holder (reference numeral 51 in FIG. 1), the contact portion 52, and the arc extinguishing chamber 6, are fitted inside the intermediate case 57, as shown in FIG. 2.

Figure 5:
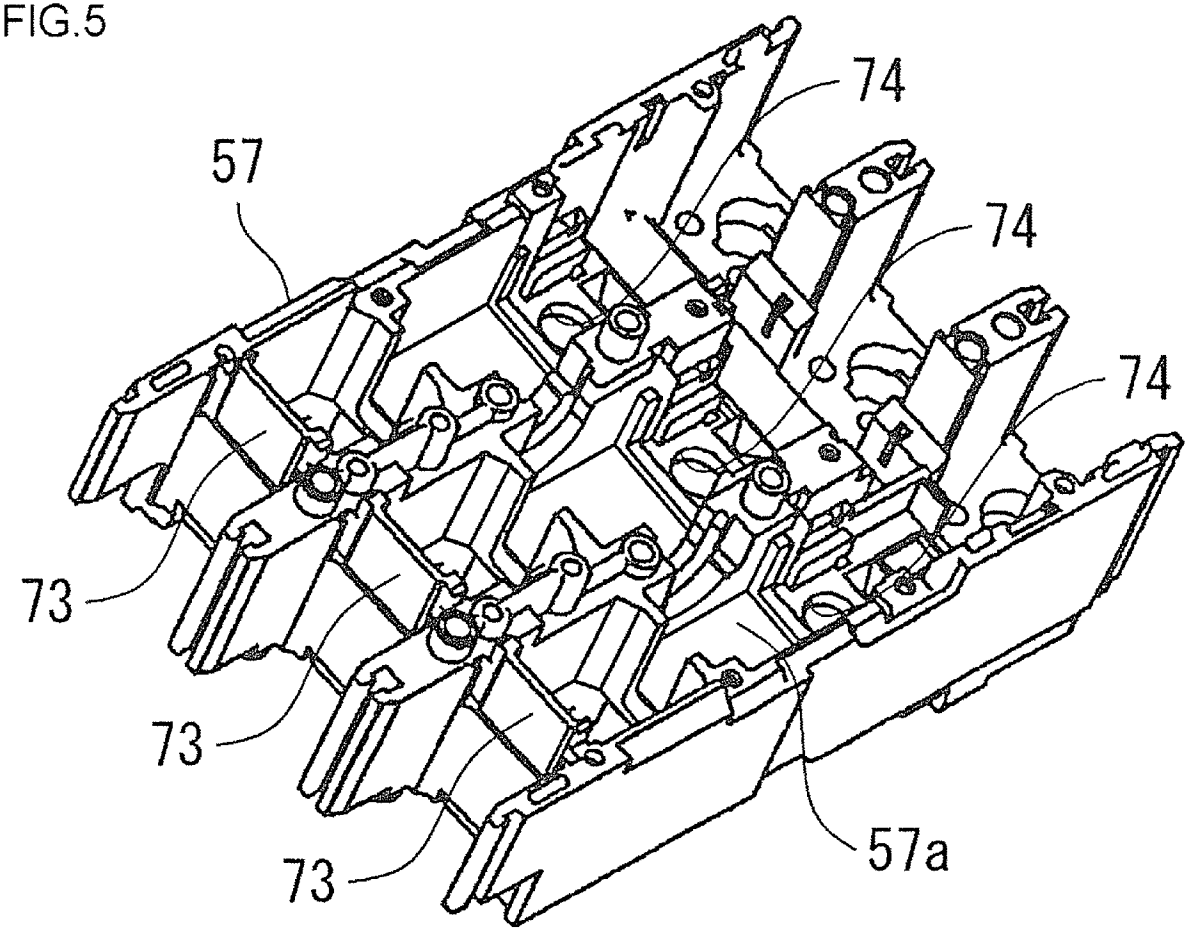
FIG. 5 is a diagram showing an intermediate case configuring the circuit breaker according to the present invention.

The intermediate case 57, as shown in FIG. 5, is such that a bottom portion (dividing wall) 57*a* that blocks off a space between the intermediate case 57 and the bottom portion case 56, and an intermediate case blocking wall portion 73, such that a wall portion rising from the bottom portion 57*a* is formed, in the vicinity in which the arc extinguishing chamber 6 is fitted, are formed in such a way as to connect an exterior side wall of the intermediate case 57 and an interphase wall, and an exhaust opening 75 that links the interior and the exterior via the intermediate case 57 and first cover 58 is formed. Also, screw insertion holes 74 corresponding to the screw insertion holes of the bottom portion case 56 are formed in the bottom portion 57*a* of the intermediate case 57 into which the load side terminal block 9 is fitted.

Meanwhile, the overcurrent tripping device 8 is fitted into the intermediate case 57 in a state in which it is connected to the load side terminal block 9, and connected with fixing screws (not shown). That is, in a state in which the intermediate case 57 is placed on the upper portion of the bottom portion case 56, the overcurrent tripping device 8 is connected by screwing the fixing screws from the bottom of the bottom portion case 56 via the screw insertion holes 70, the screw insertion holes 74 of the intermediate case 57, and the connecting board 5*c* of the contact portion including the first movable contact 5, to the overcurrent tripping device 8, and screwing threaded portions of the fixing screws to screw holes 9*a* (refer to FIG. 2) formed in an end portion of the terminal block 9 connected to the overcurrent tripping device 8.

Herein, a molded case of the invention corresponds to the case 50, an intermediate case dividing wall of the invention corresponds to the bottom portion 57*a*, and a gas path provided in a bottom portion case of the invention corresponds to the gas path 71.

Next, a description will be given of an assembly procedure of the circuit breaker of the embodiment.

Firstly, the unit formed by the latch mechanism 53, the second movable contact 4, and the power source side terminal block 3, the magnetic yoke 68, and the magnetic yoke cover 69, are fitted inside the bottom portion case 56.

Next, the first movable contact 5, the holder 51, the contact portion 52, and the arc extinguishing chamber 6, are fitted inside the intermediate case 57.

Next, the first cover 58 is placed on the upper portion of the intermediate case 57 and the switching mechanism 7 is fitted inside the first cover 58.

Next, the assemblies of the intermediate case 57 and the first cover 58 are united on the upper portion of the bottom portion case 56.

Next, the overcurrent tripping device 8 is connected by screwing the fixing screws from the bottom of the bottom portion case 56 via the screw insertion holes 70, the screw insertion holes 74 of the intermediate case 57, and the connecting board 5*c* to the overcurrent tripping device 8, and screwing the threaded portions of the fixing screws to the screw holes 9*a* formed in the end portion of the load side terminal block 9 connected to the overcurrent tripping device 8, and the overcurrent tripping device 8 is fitted inside the intermediate case 57.

Finally, the second cover 59 integrated with the top cover 60 is placed on the first cover 58 in such a way as to cover the switching mechanism 7 and overcurrent tripping device 8.

When an energizing current in the circuit breaker with the heretofore described configuration reaches an overload condition, a bimetal 16 distorts, releasing a lock of the switching mechanism 7, and the first movable contact 5 carries out a pivoting movement in the direction (opening direction) away from the second movable contact 4. Also, as the currents flowing through the second movable contact 4 and the first movable contact 5 flow in mutually opposite directions, as shown in FIG. 1, when a large current such as a short circuit current flows through the circuit breaker, the second movable contact 4 carries out a pivoting movement in the direction away from the first movable contact 5, prior to the opening action of the first movable contact 5, due to an electromagnetic repulsion acting between the second movable contact 4 and first movable contact 5.

Because of this, an arc is generated between the first movable contact point 5*a* of the first movable contact 5 and the second movable contact point 4*a* of the second movable contact 4, increasing the arc voltage, after which, the first movable contact 5 opens under a command from the overcurrent tripping device 8, and a current limiting and breaking is carried out in a short time.

When an arc is generated between the first movable contact point 5*a* and the second movable contact point 4*a*, the internal pressure of the arc extinguishing chamber 6 increases due to an expansion of the peripheral air caused by the arc heat and to the generation of a large amount of vapor from the support body forming the arc extinguishing chamber 6, and there is generated a flow of arc gas toward the exhaust opening 75 formed by the intermediate case blocking wall portion 73 and first cover 58 formed in the intermediate case 57 and the gas path 71 formed in the bottom portion case 56.

When a flow of arc gas toward the gas path 71 of the bottom portion case 56 is generated, the flow of arc gas acts as a pressing force causing the latch 65 to pivot in a clockwise direction around the shaft 64. When the latch 65 pivots in a clockwise direction around the shaft 64, the second movable contact 4 engaging with the latch 65 is held in the predetermined open position. Herein, the predetermined open position in which the latch 65 holds the second movable contact 4 is such that the length of the contact gap between the second movable contact point 4*a* and first movable contact point 5*a* is a length such that a break of the energizing path is possible.

Then, when the short circuit current is reduced and the flow of the arc gas toward the gas path 71 of the bottom portion case 56 is reduced, the urging force of the return spring 66 of the latch mechanism 53 with respect to the pressing force acting on the latch 65 increases, the latch 65 pivots in a counterclockwise direction around the shaft 64, the engagement with the second movable contact 4 is broken, and the second movable contact 4 carries out a return operation whereby it pivots in the closing direction due to the urging force of the contact spring 63.

Next, a description will be given of advantages of the circuit breaker of the embodiment.

According to the embodiment, when a large current such as a short circuit current flows, and the second movable contact 4 pivots in the opening direction due to an electromagnetic repulsion generated between the first movable contact point 5*a* of the first movable contact 5 and the second movable contact point 4*a* of the second movable contact 4, the second movable contact 4 engaging with the latch 65 continues to be held in the predetermined open position by the latch 65 of the latch mechanism 53 pivoting due to the flow of an arc gas generated toward the gas path 71 of the bottom portion case 56, meaning that, as the arc length between the first movable contact point 5*a* and the second movable contact point 4*a* does not contract, and the arc voltage does not drop, it is possible to improve current limiting performance.

Also, as the contact gap length between the first movable contact point 5*a* and second movable contact point 4*a* is maintained as a length such as to break the energizing path, it is possible to reliably carry out an energizing break when a large current such as a short circuit current flows.

Also, as it is easily possible to form discharge means that discharges the arc gas generated inside the circuit breaker to the exterior as the exhaust opening 75 formed by the intermediate case blocking wall portion 73 and first cover 58 of the intermediate case 57, which is a molded body, and the gas path 71 of the bottom portion case 56, it is possible to seek a reduction in manufacturing cost, and it is possible to increase the strength of the intermediate case 57.

Also, as a structure is such that the case main body 54 of the case 50 is configured of the bottom portion case 56 and the intermediate case 57, the latch mechanism 53, the second movable contact 4, the power source side terminal block 3, the magnetic yoke 68, and the magnetic yoke cover 69 are fitted inside the bottom portion case 56 before the intermediate case 57 is placed on the upper portion of the bottom portion case 56, and the first movable contact 5, the load side terminal block 9, the holder 51, the contact portion 52, and the arc extinguishing chamber 6 are fitted inside the intermediate case 57, it is possible to achieve good assembly ability and maintenance ability, and it is possible to increase the frame strength of the bottom portion case 56 and the intermediate case 57 when a high pressure arc gas is generated.

Also, as the latch mechanism 53, the second movable contact 4, and the power source side terminal block 3 inside the bottom portion case 56 are unitized, it is possible to reduce the stock amount of the parts of the bottom portion case 56, thus achieving good assembly workability.

Also, as the overcurrent tripping device 8 can be fitted later, using the fixing screws inserted from the bottom of the bottom portion case 56, in a state in which the intermediate case 57 is placed on the upper portion of the bottom portion case 56, and the first cover 58 is placed on the upper portion of the intermediate case 57, it is possible to respond to breaking capacity and rated current specifications by changing only the overcurrent tripping device 8, and thus possible to respond flexibly to differences in breaking capacity and rated current with a small amount of stock.

Furthermore, as it is possible to configure the cover 55 of the case 50 with the first cover 58, the second cover 59, and the top cover 60, and to fit or remove the switching mechanism 7 in a state in which the first cover 58 is placed on the upper portion of the intermediate case 57, and the second cover 59 and the top cover 60 are removed, it is possible to achieve good assembly ability and maintenance ability of the switching mechanism 7.

INDUSTRIAL APPLICABILITY

As heretofore described, the circuit breaker according to the invention is useful in providing a repulsion type circuit breaker that achieves a cost reduction by having good assembly ability and maintenance ability, and increases current-limiting performance and breaking performance.

3 . . . Power source side terminal block, 4 . . . Second movable contact, 4*a* . . . Second movable contact point, 5 . . . First movable contact, 5*a* . . . First movable contact point, 5*b* . . . Lead, 5*c* . . . Connecting board, 6 . . . Arc extinguishing chamber, 7 . . . Switching mechanism, 8 . . . Overcurrent tripping device, 9 . . . Load side terminal block, 9*a* . . . Screw hole, 13 . . . Lead, 16 . . . Bimetal, 50 . . . Case, 51 . . . Holder, 52 . . . Contact portion, 53 . . . Latch mechanism, 54 . . . Case main body, . . . Cover, 56 . . . Bottom portion case, 57 . . . Intermediate case, 57*a* . . . Bottom portion, 58 . . . First cover, 59 . . . Second cover, 60 . . . Top cover, 61 . . . Side plate, 61*a*, 61*b*. Parallel plate, 62 . . . Shaft, 63 . . . Contact spring, 64 . . . Shaft, 65 . . . Latch, 66 . . . Return spring, 67 . . . Gas pressure base, 68 . . . Magnetic yoke, 69 . . . Magnetic yoke cover, 70 . . . Screw insertion portion, 71 . . . gas path, 73 . . . Intermediate case blocking wall, 74 . . . Screw insertion hole, 75 . . . Exhaust opening

What is claimed is:

1. A circuit breaker, comprising:

a molded case constructed of a case main body and a cover placed on an upper portion of the case main body, and housing:

a first movable contact having a first movable contact point disposed at a leading end thereof;

a contact portion pivotally supporting the first movable contact through an insulating holder;

a second movable contact having a second movable contact point disposed at a leading end thereof to contact with the first movable contact point, and connected to a power source side terminal block through a lead;

a switching mechanism to switch the first movable contact;

a load side terminal block connected to the first movable contact;

an overcurrent tripping device connected to the load side terminal block;

an arc extinguishing chamber to extinguish an arc generated between the first movable contact point and the second movable contact point; and a latch mechanism having a latch operating together with a second movable contact, which opens in response to an electromagnetic repulsive force of a short circuit current, and holding the second movable contact in a predetermined open position through the latch, which pivots by an increase of an internal pressure of the arc extinguishing chamber due to the generation of the arc, wherein the case main body comprises a bottom case forming a bottom portion of the circuit breaker, and an intermediate case mounted on an upper portion of the bottom case and having a dividing wall blocking a space between the intermediate case and the bottom case, the power source side terminal block and the second movable contact are fitted inside the bottom case, the first movable contact, the load side terminal block, the overcurrent tripping device, the holder, the contact portion, and the arc extinguishing chamber are fitted inside the intermediate case;

the latch mechanism further comprises a side plate pivotally supporting a contact spring urging the second movable contact toward the first movable contact and the latch through shafts, and a gas pressure base covering the side plate, the latch mechanism and the power source side terminal block connected to the second movable contact through the lead are formed into a unit, and the unit, a magnetic yoke enclosing the second movable contact point of the second movable contact from left and right so that side portions thereof extend upright in an opening movement direction of the second movable contact, and a magnetic yoke cover covering the left and right side portions of the magnetic yoke from inner and outer sides, are fitted inside the bottom case.

2. A circuit breaker according to claim 1, wherein the cover comprises a first cover placed on an upper portion of the intermediate case, a second cover placed on an upper portion of the first cover, and a top cover placed on an upper portion of the second cover, the switching mechanism is fitted from the upper portion of the first cover in a state in which the second cover and the top cover are removed.

3. A circuit breaker according to claim 1, wherein the overcurrent tripping device is connected to the load side terminal block fitted inside the intermediate case, and in a state in which the second cover and the top cover are removed, fixing screws are inserted into cylindrical screw insertion holes formed from the bottom of the bottom case toward the intermediate case, and the fixing screws are screwed to the overcurrent tripping device.

4. A circuit breaker, comprising:

a molded case constructed of a case main body and a cover placed on an upper portion of the case main body, and housing:

a first movable contact having a first movable contact point disposed at a leading end thereof;

a contact portion pivotally supporting the first movable contact through an insulating holder;

a second movable contact having a second movable contact point disposed at a leading end thereof to contact with the first movable contact point, and connected to a power source side terminal block through a lead;

a switching mechanism to switch the first movable contact;

a load side terminal block connected to the first movable contact;

an overcurrent tripping device connected to the load side terminal block;

an arc extinguishing chamber to extinguish an arc generated between the first movable contact point and the second movable contact point; and a latch mechanism having a latch operating together with a second movable contact, which opens in response to an electromagnetic repulsive force of a short circuit current, and holding the second movable contact in a predetermined open position through the latch, which pivots by an increase of an internal pressure of the arc extinguishing chamber due to the generation of the arc, wherein the case main body comprises a bottom case forming a bottom portion of the circuit breaker, and an intermediate case mounted on an upper portion of the bottom case and having a dividing wall blocking a space between the intermediate case and the bottom case, the power source side terminal block and the second movable contact are fitted inside the bottom case, the first movable contact, the load side terminal block, the overcurrent tripping device, the holder, the contact portion, and the arc extinguishing chamber are fitted inside the intermediate case, and a gas path is formed in a position on a load side terminal block side relative to the latch mechanism of the bottom case.

5. A circuit breaker according to claim 4, wherein the gas path communicates with an external air from a side portion of the bottom case.

* * * * *

UNITED STATES PATENT AND TRADEMARK OFFICE

CERTIFICATE OF CORRECTION

PATENT NO. : 8,717,127 B2
APPLICATION NO. : 13/702879
DATED : May 6, 2014
INVENTOR(S) : Shinichiro Ando et al.

It is certified that error appears in the above-identified patent and that said Letters Patent is hereby corrected as shown below:

In SPECIFICATION,

Please change the column 6, line 40, “holes of” to --holes 70 of--.

Please delete the column 9, line 17 to line 33.

In CLAIMS,

Please change the column 10, line 6, “case;” to --case,--.

Please change the column 11, line 12, “claim 4,” to --claim 7,--.

Signed and Sealed this
Twenty-third Day of December, 2014

Michelle K. Lee

Michelle K. Lee
*Deputy Director of the United States Patent and Trademark Office*